US006776321B2

(12) United States Patent
Jairam et al.

(10) Patent No.: US 6,776,321 B2
(45) Date of Patent: Aug. 17, 2004

(54) HEAVY DUTY STAPLER

(75) Inventors: Anthony Jairam, Sunrise, FL (US); Bikram Sohi, Wheeling, IL (US)

(73) Assignee: ACCO Brands, Inc., Lincolnshire, IL (US)

( * ) Notice: Subject to any disclaimer, the term of this patent is extended or adjusted under 35 U.S.C. 154(b) by 0 days.

(21) Appl. No.: 10/079,378

(22) Filed: Feb. 20, 2002

(65) Prior Publication Data

US 2003/0155400 A1 Aug. 21, 2003

(51) Int. Cl.[7] ..... B25C 5/06

(52) U.S. Cl. ..... 227/134; 227/127; 227/154; 227/120; 227/134

(58) Field of Search ..... 227/134, 132, 227/129, 146, 120, 127, 154

(56) References Cited

U.S. PATENT DOCUMENTS

| | | | | | |
|---|---|---|---|---|---|
| 1,962,874 | A | * | 6/1934 | Polzer | 227/123 |
| 1,998,328 | A | * | 4/1935 | Mckinnie | 227/129 |
| 5,492,261 | A | | 2/1996 | Chi | |
| 5,639,007 | A | * | 6/1997 | Nakamura | 227/109 |
| 5,758,813 | A | * | 6/1998 | Kikuchi et al. | 227/155 |
| 5,979,736 | A | | 11/1999 | Edeholt | |
| 6,179,193 | B1 | * | 1/2001 | Nagai | 227/123 |
| 6,244,491 | B1 | | 6/2001 | Kandasamy et al. | |

OTHER PUBLICATIONS

Prior art Swingline 900XD, photo numbers 1496, 1497, and 1498.
Prior art Swingline 39 Heavy Duty Stapler, photo numbers 1501, 1502, and 1503.
Prior art Bostitch Model B300HDS, photo numbers 1505, 1506, and 1507.
Prior art Bostitch Model B310HDS, photo numbers 1511, 1512, and 1513.
Prior art Swingline 390, photo numbers 1515, 1516, and 1517.
Prior art Bostitch Model 00540, photo numbers 1520, 1521, and 1522.
Prior art Bostitch Model 136, stock No. 73136, photo numbers 1525, 1526, and 1527.
Prior art Swingline 390, photo numbers 1530, 1531, and 1532.
Prior art Swingline 390, photo numbers 1533, 1534, and 1535.
Prior art Swingline 413, photo numbers 1536, 1537, and 1538.
Prior art Acco Brands staplers: Acco Brands Fact Book 2001 Catalog p. 187.

* cited by examiner

*Primary Examiner*—Stephen F. Gerrity
*Assistant Examiner*—Thanh Truong
(74) *Attorney, Agent, or Firm*—Michael Best & Friedrich LLP

(57) ABSTRACT

A stapler comprising a base defining a horizontal plane, a cartridge assembly coupled to the base at a cartridge attachment point, the cartridge assembly including a ram, and a lever arm pivotally coupled to the base at a lever pivot axis. The lever arm includes a grip for receiving a manual input from a user, and the lever arm is coupled to the ram at a ram input in order to provide a drive force. The stapler includes an inherent force factor, calculated as the horizontal distance from the lever pivot axis to the end of the lever arm divided by the horizontal distance from the lever pivot axis to the ram input, of at least 3.8. Preferably, the lever arm defines an effective lever axis that is at least about 65° offset from the ram axis when in the static position. When stapling, the effective lever axis is preferably offset greater than about 95° when the lever arm is compressed to the fully stapled position.

10 Claims, 4 Drawing Sheets

HEAVY DUTY STAPLER

FIELD OF THE INVENTION

The present invention relates to staplers and, more specifically, to heavy-duty staplers.

BACKGROUND OF THE INVENTION

Heavy duty staplers typically include a base, a cartridge assembly pivotally mounted to the base, and a lever assembly including a lever arm that will provide a force to the cartridge assembly to drive a staple through a stack of sheets. The lever arm is commonly pivotally mounted to either the cartridge assembly or the base.

There are many characteristics of a heavy-duty stapler that define the quality of the stapler. For example, one important characteristic is the stapler's ability to consistently drive a staple through a thick stack of sheets without staple failure and without jamming the magazine. Another characteristic is the amount of force required to use the stapler. It can be appreciated that it would be desirable to produce a stapler that can consistently drive staples through a stack of sheets without failure and with a reduced force applied to the lever arm.

SUMMARY OF THE INVENTION

The present invention provides a stapler that is designed to require less force on the lever arm in order to drive a staple through a stack of sheets. This is accomplished by the relative positioning between the pivot points of the cartridge assembly and lever assembly, and the connection between the cartridge assembly and the lever assembly.

More specifically, the present invention provides a stapler comprising a base defining a horizontal plane, a cartridge assembly coupled to the base at a cartridge attachment point, the cartridge assembly including a ram, and a lever arm pivotally coupled to the base at a lever pivot axis. The lever arm includes a grip at one end for receiving a manual input from a user, and the lever arm is coupled to the ram at a ram input in order to provide a drive force. The stapler includes an inherent force factor, calculated as the horizontal distance from the lever pivot axis to the end of the lever arm divided by the horizontal distance from the lever pivot axis to the ram input, of is at least 3.8 (preferably at least 3.9).

In one embodiment, the cartridge assembly includes a cartridge housing, and the ram is slidable relative to the cartridge housing along a ram axis. In the static position, the lever arm defines an effective lever axis that is at least about 65° (preferably at least about 70° and most preferably about 72.4°) offset from the ram axis. When stapling, the effective lever axis is greater than about 95° (preferably at least about 100° and most preferably about 103°) when the lever arm is compressed to the fully stapled position.

Figure 1:
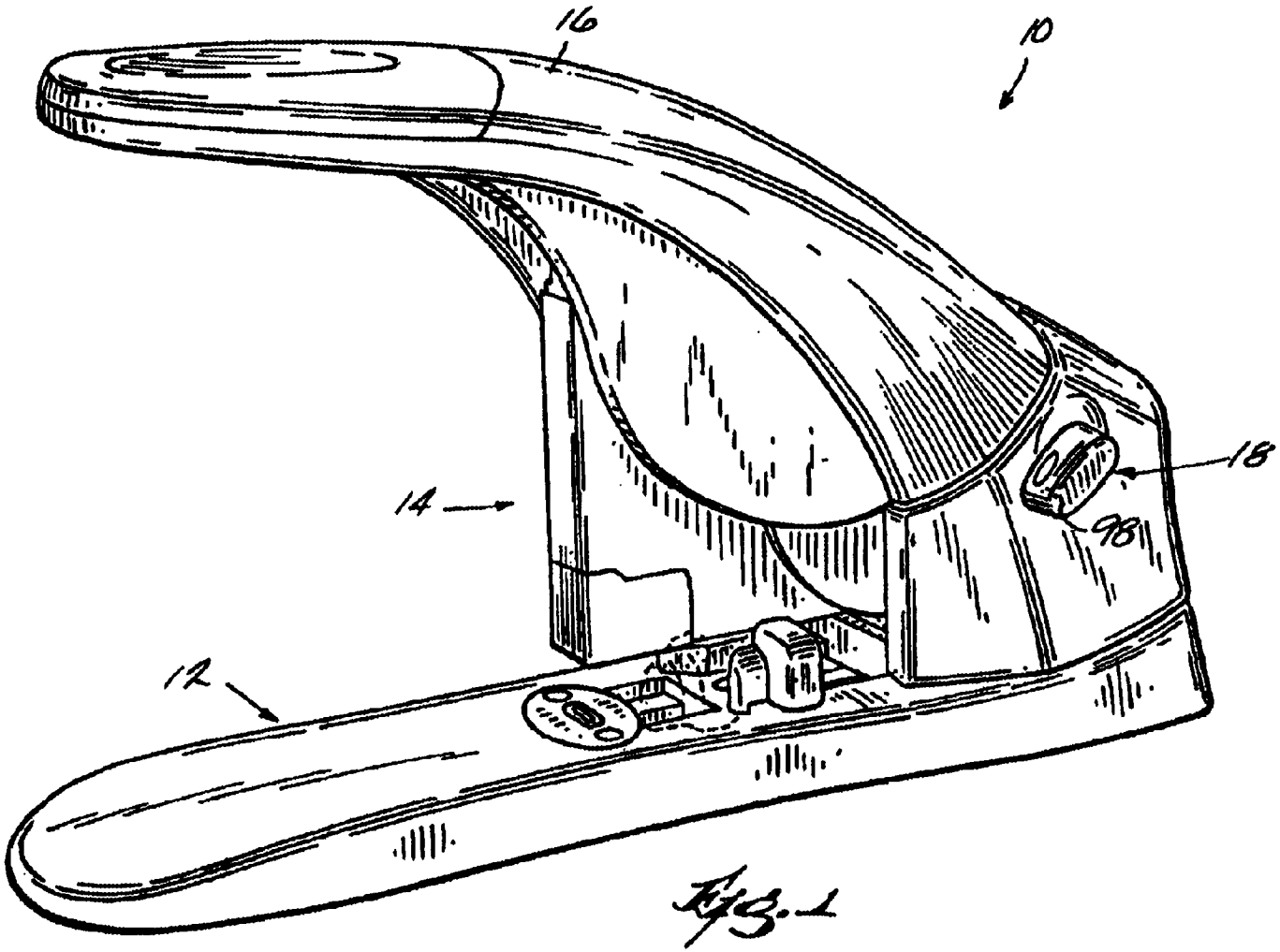
FIG. 1 is a perspective view of a heavy-duty stapler embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

The illustrated heavy duty stapler 10 includes a base assembly 12, a cartridge assembly 14 pivotally mounted to the base assembly 12, a lever arm 16 pivotally mounted to the base assembly 12, and a jam clearing mechanism 18 that facilitates clearing of a jammed staple. The specifics of each of these assemblies are provided below.

Figure 5:
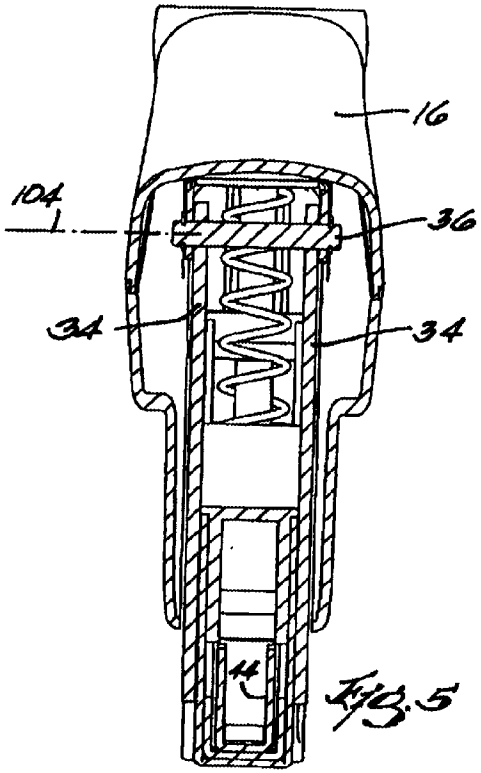
FIG. 5 is a section view taken along line 5—5 in FIG. 2.

The base assembly 12 includes a base 20 having a bottom surface 22 designed to rest upon a support surface, and a top surface 24 designed to support a stack of sheets during the stapling process. An anvil 26 is mounted to the top surface 24 and is designed to deform the ends of the staple under the stack of sheets. A paper guide 28 is mounted to the top surface 24 to facilitate positioning of the stack prior to the stapling process. The base assembly 12 further includes an upper housing 30 that supports a cartridge pivot rod 32 that pivotally connects the cartridge assembly 14 to the base assembly 12. The base assembly 12 further includes two laterally-opposed lever supports 34 (see FIGS. 2 and 5) that support a lever pivot rod 36 that pivotally connects the lever arm 16 to the base assembly 12.

The cartridge assembly 14 includes a cartridge housing 38 that pivots on the cartridge pivot rod 32. A magazine is positioned in the cartridge housing 38 and is designed to feed staples for the stapling process. The magazine includes a magazine housing 42 and a rail 44 positioned in the magazine housing 42 for supporting staples along a longitudinal axis 46 (FIG. 2) defined by the magazine. The magazine housing 42 includes a dispensing opening 47 through which staples are forced during the stapling process. The rail 44 can move longitudinally relative to the magazine housing 42 from a static position adjacent a front wall 48 of the magazine housing 42 near the dispensing opening 47 (FIG. 2) to a retracted position away from the front wall. A rail spring 50 biases the rail 44 relative to the magazine housing 42 and toward the static position. A front edge 52 of the rail 44 is angled to facilitate driving a staple into a stack of sheets, as described below in more detail. A pusher 54 is slidable on the rail 44, and a pusher spring 56 supplies a biasing force on the pusher 54 to keep the staples 58 constantly biased against the front wall 48 of the magazine housing 42.

Figure 2:
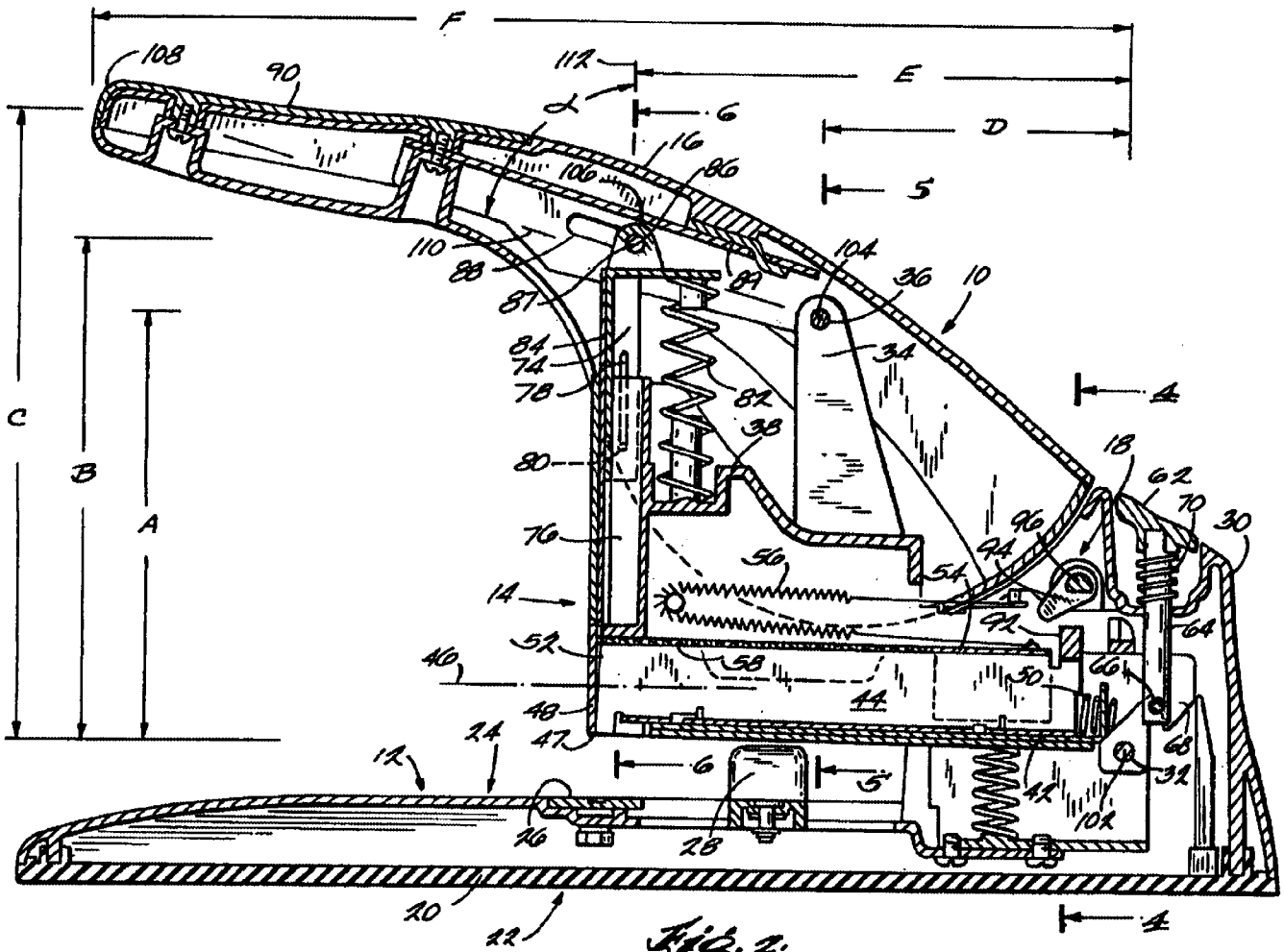
FIG. 2 is a side section view of the stapler shown in FIG. 1 in the static position.

The magazine is movable longitudinally relative to the cartridge housing 38 from a closed position (FIG. 2) to an open position (not shown) to facilitate loading of staples 58 into the magazine. The magazine is biased toward the open position by the pusher spring 56, and can be held in the closed position by a magazine retainer. The magazine retainer includes a release button 62, a plunger 64 connected to the release button 62, a keeper 66 mounted to the plunger, and a latch 68 formed in the magazine housing 42. The keeper 66 is designed to engage the latch 68 to hold the magazine in the closed position (FIG. 2). The release button 62 can be pushed by the user to disengage the keeper 66 from the latch 68, thus allowing the magazine to move toward the open position under the biasing force of the pusher spring 56. The release button 62, plunger 64, and keeper 66 are biased upward by a release spring 70.

Staples are pushed into a stack of sheets by a ram assembly (FIG. 2) including a ram 74 designed to slide within a recess 76 in the cartridge housing 38. The ram 74 includes a slot 78 that interacts with a pin 80 in the cartridge housing 38 to limit the range of movement of the ram relative to the cartridge housing 38. The ram 74 is biased upward relative to the cartridge housing 38 by a ram spring 82. A driver blade 84 is connected to the ram 74 and is designed to transfer force from the ram 74 to the staple being driven into the stack. The upper end of the ram 74 is provided with a rounded boss 86 that provides sliding interaction between the lever arm 16 and the ram 74. Alternatively, there could be rolling or other interaction between the lever arm 16 and the ram 74.

The lever arm 16 is pivotally coupled to the base 20 via the lever supports 34 and the lever pivot rod 36. The lever arm 16 includes a slot 88 that receives a ram pin 87 and provides a coupling between the lever arm 16 and the ram 74. A lever plate 89 provides a surface for contacting the rounded boss 86. A grip 90 provides a location for the user to apply a manual force for the stapling operation.

The jam clearing mechanism 18 is designed to provide a manual device that can move the rail 44 toward the retracted position to thereby increase the space between the front edge 52 of the rail 44 and the front wall 48. The goal is to allow a jammed staple to fall out of the magazine by gravity. The jam clearing mechanism 18 includes a retractor adapted to engage the rail 44 and move the rail 44 toward the retracted position. In the illustrated embodiment, the retractor is designed to engage a tab 92 on the rail 44. More specifically, the retractor can be moved from a disengaged position out of engagement with tab 92 to an engaged position in engagement with tab 92. Further movement of the retractor will move the rail 44 away from the front wall 48 to achieve the desired result.

Figure 3:
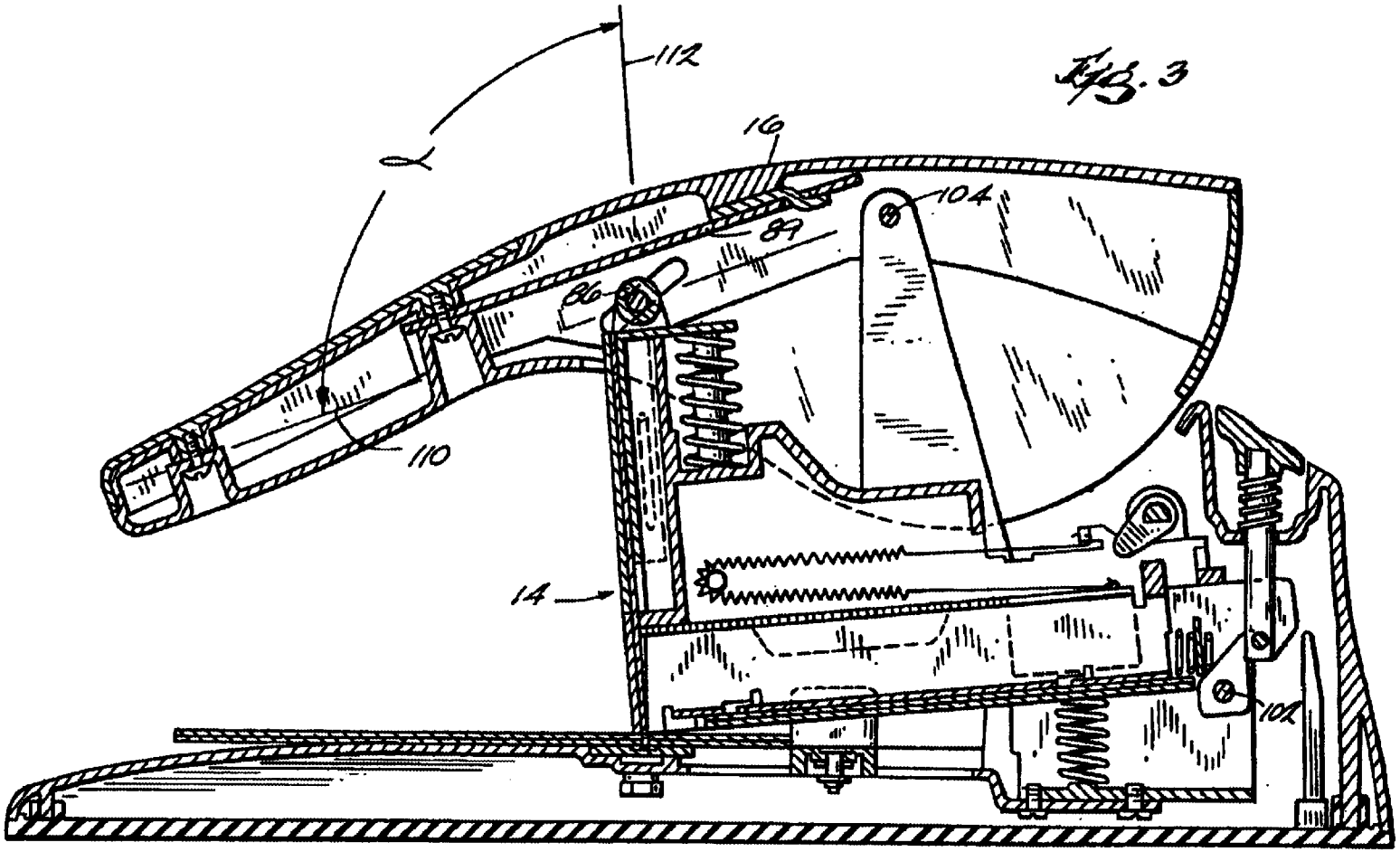
FIG. 3 is the side section view of FIG. 2 with the stapler in the stapling position.
Figure 6:
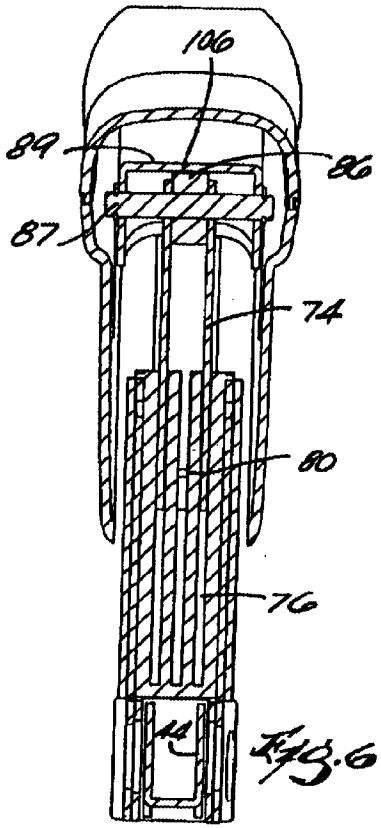
FIG. 6 is a section view taken along line 6—6 in FIG. 2.
Figure 4:
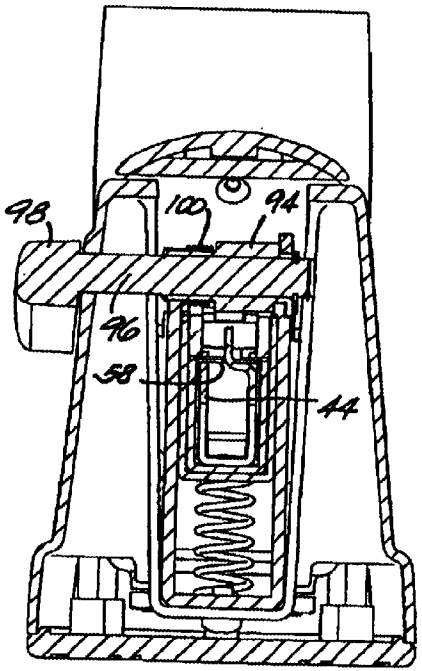
FIG. 4 is a section view taken along line 4—4 in FIG. 2.

In the illustrated embodiment, the retractor is mounted to the base 20 and includes an actuator 94, a rotatable shaft 96 for rotatably supporting the actuator 94, and a handle 98 (FIG. 1) for manually rotating the actuator 94. The actuator 94 can be rotated from the disengaged position (FIG. 3) to the engaged position (not shown) by rotating the handle 98. In the disengaged position, the actuator 94 is not aligned with the tab 92 in a direction parallel to the longitudinal axis 46. In the illustrated embodiment, the entire actuator 94 remains higher than the tab 92, thereby providing clearance between the tab 92 and the actuator 94 when the magazine is slid out of the cartridge housing 38. This feature facilitates removal of the magazine from the cartridge housing 38 for loading of staples. The retractor is biased toward the disengaged position by a torsion spring 100 (FIG. 4).

Referring to FIG. 2, it is believed that the relative relationships of components and their associated dimensions enhance the operation by reducing the force required to perform the stapling operation. More specifically, the relative positions of the cartridge pivot axis 102, the lever pivot axis 104, the ram input 106 (the point where the lever applies force to the ram), and the lever end 108 (the point of the lever arm 16 furthest from the lever pivot axis 104) will positively affect the ease with which the stapling operation can be performed. The relative positions are illustrated in Cartesian coordinates with the cartridge pivot axis 102 as the datum and the vertical and horizontal distance to the other locations given a letter designation. The vertical distance to the lever pivot axis 104 is denoted as "A", the vertical distance to the ram input 106 is denoted as "B", and the vertical distance to the lever end 108 is denoted as "C". The horizontal distance to the lever pivot axis 104 is denoted as "D", the horizontal distance to the ram input 106 is denoted as "E", and the horizontal distance to the lever end 108 is denoted as "F".

The dimensions of the illustrated embodiment are A=10.6 cm, B=13.1 cm, C=15.7 cm, D=7.6 cm, E=12.3 cm, and F=25.9 cm. These dimensions can be used to illustrate a beneficial feature of the present invention, which for simplicity is called the "force factor". The force factor is defined as the ratio of the maximum lever arm length (F-D) to the distance from the lever pivot axis 104 to the ram input 106 (E-D) when the lever arm 16 is in the static position (FIG. 2).

$$\text{force factor} \approx (F\text{-}D)/(E\text{-}D)$$

In this embodiment, the approximate force factor is 3.91. It is believed that this force factor results in a lower force required to perform the stapling operation.

Another feature of the illustrated stapler is that the static position of the lever arm 16 is almost perpendicular to a ram axis 112 (which is approximately vertical in the static position). More specifically, the lever-ram angle $\alpha$ is represented in the drawings as the angle between an effective lever axis 110 (defined by the lever pivot axis 104 and the point on the lever end 108 that is furthest from the lever pivot axis 104) and the ram axis 112. This can be approximated by calculating the ratio of the lever arm vertical height (from the lever pivot axis 104 to the highest point on the lever end 108 (C-A)) to the lever arm horizontal length (from the lever pivot axis 104 to the furthest horizontal point on the lever end 108 (F-D)) and taking the inverse cotangent of that ratio.

$$\text{lever-ram angle } (\alpha) \approx \text{cotan}^{-1}((C\text{-}A)/(F\text{-}D))$$

In the illustrated embodiment, the lever-ram angle $\alpha$ is about 74.4° when the lever arm 16 is in the static position (FIG. 2). As shown in FIG. 2, by virtue of this lever-ram angle $\alpha$, the lever arm 16 in the static position is almost perpendicular to the drive force applied to the ram 74. As the lever arm 16 is pushed down during the stapling operation, the lever passes through the point of perpendicularity with the ram axis 112 to a lever-ram angle $\alpha$ of about 103° when the lever arm 16 is fully compressed in the stapling position, as shown in FIG. 3. Thus, during the stapling operation, the lever arm 16 achieves and surpasses a point of perpendicularity with the ram axis 112, and thus a large portion of the force applied by the user will be translated to useful force applied to the ram 74 during the stapling operation.

Various features of the invention are set forth in the following claims.

What is claimed is:

1. A stapler comprising:

a base defining a horizontal plane;

a cartridge assembly coupled to the base forming a cartridge pivot axis, the cartridge assembly including a ram; and a lever arm pivotally coupled to the base at a lever pivot axis, the lever arm including a grip at an end for receiving a manual input from a user, and the lever arm being coupled to the ram at a ram input in order to provide a drive force;

wherein the stapler includes an inherent force factor calculated as the horizontal distance from the lever pivot axis to the lever end divided by the horizontal distance from the lever pivot axis to the ram input, wherein the force factor is at least about 3.8, wherein when the lever arm is in a static position, the stapler includes a first vertical distance from the cartridge pivot axis to the end of the lever arm, and a second vertical distance from the cartridge pivot axis to the lever pivot axis, and wherein the ratio of the first vertical distance to the second vertical distance is less than about 1.5.

2. The stapler of claim 1, wherein the ratio of the first vertical distance to the second vertical distance is about 1.48.

3. The stapler of claim 1, wherein the cartridge assembly further includes a cartridge housing, wherein the ram is slidable relative to the cartridge housing along a ram axis.

4. The stapler of claim 3, wherein the lever arm includes an effective lever axis defined by the lever pivot axis and the end, and wherein a static angle between the effective lever axis and the ram axis is at least about 65° when the lever arm is in a static position.

5. The stapler of claim 4, wherein the static angle is at least about 70°.

6. The stapler of claim 4, wherein the static angle is about 74.4°.

7. The stapler of claim 3, wherein the lever arm includes an effective lever axis defined by the lever pivot axis and the end, and wherein a compressed angle between the effective lever axis and the ram axis is at least about 95° when the lever arm is compressed to the fully stapled position.

8. The stapler of claim 7, wherein the compressed angle is at least about 100°.

9. The stapler of claim 7, wherein the compressed angle is about 103°.

10. The stapler of claim 1, wherein the force factor is at least about 3.9.

* * * * *